US007805098B2

(12) United States Patent
Kimura et al.

(10) Patent No.: US 7,805,098 B2
(45) Date of Patent: Sep. 28, 2010

(54) DEVELOPMENT DEVICE AND IMAGE FORMING APPARATUS COMPRISING SAME

(75) Inventors: Takahiko Kimura, Ikoma (JP); Shigeki Hayashi, Ikoma-gun (JP); Shuichi Akedo, Sakai (JP); Teruyoshi Sudoh, Yamatokoriyama (JP); Tomoya Usui, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 246 days.

(21) Appl. No.: 12/041,394

(22) Filed: Mar. 3, 2008

(65) Prior Publication Data

US 2008/0219699 A1 Sep. 11, 2008

(30) Foreign Application Priority Data

Mar. 8, 2007 (JP) ..... 2007-059169

(51) Int. Cl.
*G03G 15/08* (2006.01)
*G03G 15/04* (2006.01)

(52) U.S. Cl. ..... 399/258; 399/120; 399/119; 399/260; 399/262

(58) Field of Classification Search ..... 399/119, 399/120, 258, 259, 260, 263
See application file for complete search history.

(56) References Cited

U.S. PATENT DOCUMENTS 3,954,331 A * 5/1976 Smith ..... 399/106
5,587,777 A 12/1996 Miyaji et al.
7,010,250 B1 3/2006 Yahagi
7,187,876 B2 * 3/2007 Ito et al. ..... 399/27
7,566,013 B2 * 7/2009 MacLean-Blevins ..... 239/310
2004/0091288 A1 5/2004 Yahagi
2006/0078355 A1 4/2006 Yahagi
2007/0223970 A1 9/2007 Kawai
2007/0237544 A1 10/2007 Kawai
2008/0089721 A1 4/2008 Yahagi
2008/0159782 A1 7/2008 Yahagi
2008/0175629 A1 * 7/2008 Eto et al. ..... 399/262

FOREIGN PATENT DOCUMENTS

JP 02284166 A * 11/1990

(Continued)

OTHER PUBLICATIONS

Toshihiro Sugikubo, Process Cartridge, Nov. 21, 1990, abstract.*

*Primary Examiner*—David M Gray
*Assistant Examiner*—Francis Gray
(74) *Attorney, Agent, or Firm*—Nixon & Vanderhye, PC

(57) ABSTRACT

The development device of the present invention has a rotating shutter supported rotatably between a supply opening formed on a toner supply device and a receiving opening formed on a developing tank. The rotating shutter has an open section extending in the axial direction of the roller-shaped main section as well as opened in the direction perpendicular to the axial direction thereof, opening and shutting the supply opening in conjunction with attachment and detachment operation of the developing tank. The rotating shutter shuts the supply opening by covering the supply opening with the outer surface of the roller-shaped main section, and opens the supply opening by communicating the supply opening and the receiving opening through the open section. Thus, it is possible to prevent the leakage of toner even after repetitively performing the attachment and detachment operation of the developing tank.

20 Claims, 15 Drawing Sheets

FOREIGN PATENT DOCUMENTS

| | | | |
|---|---|---|---|
| JP | 8-152784 | | 11/1996 |
| JP | 2001-222160 | A | 8/2001 |
| JP | 2005-106896 | | 4/2005 |
| JP | 2006-65112 | A | 3/2006 |
| JP | 2006-284782 | A | 10/2006 |
| JP | 2007-272183 | A | 10/2007 |

* cited by examiner

DEVELOPMENT DEVICE AND IMAGE FORMING APPARATUS COMPRISING SAME

This Nonprovisional application claims priority under 35 U.S.C. §119(a) on Patent Application No. 059169/2007 filed in Japan on Mar. 8, 2007, the entire contents of which are hereby incorporated by reference.

FIELD OF THE TECHNOLOGY

The present technology relates to a development device used in an image forming apparatus such as an electrostatic copier, a laser printer, or a facsimile, and an image forming apparatus, each of which includes such a development device. More precisely, the present technology relates to a development device using a two component developer including toner and carrier, and an image forming apparatus equipped with such a development device.

BACKGROUND OF THE TECHNOLOGY

In an image forming apparatus using an electrophotographic printing method, image-forming is performed such that an electrostatic latent image is formed on a photoconductive drum, toner is then adhered to this latent image, thereby to form a toner image therefrom, and the toner image is transferred to a printing medium and is fixed thereto.

In promoting the speeding-up and further high image quality, the development of an image forming apparatus of a two component development has been implemented for such image forming apparatus, in which a two component developer including toner and carrier is used.

A development device equipped in the image forming apparatus of a two component development generally includes a developing tank and a toner supply device. The developing tank contains a two component developer and has a development section such as a development roller or the like. The developing tank supplies the toner included in the two component developer to the photoconductive drum. The toner supply device is used to supply the toner to the developing tank.

The toner included in the two component developer of the developing tank is consumed for forming an image as above, therefore the development device can be used for a long term by supplying the toner from the toner supply device to the developing tank according to the amount of consumption of the toner.

On the other hand, the carrier included in the two component developer in the developing tank will not be consumed for forming an image. However, the carrier deteriorates by being used, therefore after a certain period passes from the start of use, maintenance to replace the two component developer in the development tank with a new two component developer is conducted.

Additionally, the conventional image forming apparatus is designed such that the developing tank storing the two component developer can be detached singularly from the image forming apparatus, in order to increase the effectiveness of this maintenance.

In the image forming apparatus with the developing tank provided detachable, it is necessary to prevent the dirtying within the apparatus (within the image forming apparatus). The dirtying would be caused by scattering or dropping the toner from the toner supply opening section of the toner supply device or an receiving opening of the developing tank, when attaching or detaching the developing tank.

Conventionally, there have been various proposals as a technique to prevent or restrain the dirtying within the apparatus caused by the detachability of the developing tank. One of these proposals is, for example, Patent Document 1. Patent Document 1 discloses a mechanism such that an opening provided on the toner supply section of the toner supply device opens and shuts by a shutter of a sheet form, in conjunction with the attaching and detaching operation of the developing tank.

Patent Document 1: Japanese Unexamined Patent Publication, Tokukaihei, No. 8-152784 (published on Jun. 11, 1996)

However, with a door-type structure opening and shutting the opening with one side of the sheet-formed shutter as the turning shaft as in the structure disclosed in the aforementioned Patent Document 1, the toner will adhere around the opening while using the apparatus.

If the adhered toner hardens, the toner becomes sandwiched between the shutter and the wall surface where the opening is formed, and the shutter will not shut completely. In addition, even if the shutter is completely shut, there is the problem that the toner adhered on the periphery of the shutter would drop or scatter due to vibration or the like, thereby causing dirtying.

SUMMARY OF THE TECHNOLOGY

A first object is to provide a development device which can unfailingly shut the supply opening of the toner supply device for a long term, and to provide an image forming apparatus equipped with such a development device. A second object is to further provide a development device also preventing dirtying caused by the toner adhered on the periphery of the shutter, and to further provide an image forming apparatus equipped with such a development device.

In order to achieve the first object, the development device includes a developing tank, which is detachable, for containing a two component developer including toner and carrier; a toner supply device for containing toner and supplying the toner to the developing tank; a communicating chamber between a supply opening and a receiving opening, for communicating an inside of the toner supply device and an inside of the developing tank, wherein the supply opening is formed on the toner supply device and the receiving opening is formed on the developing tank and receives the toner from the supply opening; and a shutter member being supported rotatably in the communicating chamber, for opening and shutting the supply opening in conjunction with attachment and detachment operation of the developing tank, the shutter member including a roller-shaped main section with an open section formed extending in an axial direction thereof as well as opened in a direction perpendicular to the axial direction, for shutting the supply opening by covering the supply opening with an outer surface of the roller-shaped main section, and opening the supply opening by communicating the supply opening and the receiving opening through the open section.

In addition, the image forming apparatus is equipped with such a development device.

The shutter member in the structure has an open section on the roller-shaped main section, extending in an axial direction and opened in the direction perpendicular to the axial direction thereof. The supply opening is shut by covering the supply opening with an outer surface of the roller-shaped main section, and is opened by communicating the supply opening and the receiving opening through the open section.

The outer surface of the roller-shaped main section slides as to friction the supply opening with the rotation of the shutter member. Thus, the toner adhesion is less likely to occur on the vicinity of the supply opening, compared to the door-type structure as described in Patent Document 1.

Moreover, the outer surface of the roller-shaped main section has a curvature, so the outer surface of the roller-shaped main section is tangent with the supply opening. Therefore, compared to the door-type structure of Patent Document 1 with the shutter having plane contact with the vicinity of the supply opening, the decrease in shielding function due to the adhered toner on the vicinity of the supply opening is less likely to occur.

Furthermore, in the case of the door-type as described in Patent Document 1 or a structure sliding a sheet-shaped shutter, it is required to secure a space for the movement of the shutter. However, by making the shutter member a roller-type, the opening and shutting of the supply opening can be performed by rotating the shutter member in the same position. Therefore, the space required for the shutter member can be small, which results to the downsizing of the development device, consequently the downsizing of the image forming apparatus equipped with such development device.

Thus, the development device and the image forming apparatus equipped with such development device is provided, each of which the supply opening of the toner supply device can be unfailingly shut for a long term.

In addition, in order to achieve the second object, the development device further includes a blocking wall in the vicinity of the receiving opening side of the communicating chamber, for blocking the communicating chamber from the receiving opening; the communicating chamber communicating with the developing tank through a discharge opening formed on the blocking wall and the receiving opening; and the shutter member shutting the discharge opening by covering the discharge opening with an outer surface of the roller-shaped main section, when the shutter member shuts the supply opening by covering the supply opening with the outer surface of the roller-shaped main section.

According to the structure, a blocking wall is provided in the vicinity of the receiving opening side of the communicating chamber where the shutter member is positioned, and the toner inside the toner supply device is supplied through the discharge opening formed on the blocking wall to the developing tank side. Consequently, the shutter member shuts the discharge opening when shutting the supply opening.

That is to say, according to the above, when the supply opening is shut, in other words when the developing tank is drawn out from the apparatus (out of the image forming apparatus), not only the supply opening but also the communicating chamber itself containing the shutter member is also shielded. As such, the apparatus is less likely dirtied by the toner adhered within the shutter member and the communicating chamber.

Thus, the development device and the image forming apparatus equipped with such development device is provided, each of which is possible to not only unfailingly shut the supply opening of the toner supply device for a long term, but also prevent the dirtying caused by the toner adhered on the periphery of the shutter member.

Additional objects, features, and strengths of the technology will be made clear by the description below. Further, the advantages will be evident from the following explanation in reference to the drawings.

BRIEF DESCRIPTION OF THE DRAWINGS

FIG. 4(*a*) illustrates a direction of the rotating shutter when the interlocking section is pressured, and FIG. 4(*b*) illustrates the direction of the rotating shutter when the interlocking section is not pressured.

FIG. 5(*a*) illustrates a state in which the rotating shutter equipped on the development device is opening the supply opening, and FIG. 5(*b*) illustrates a state in which the rotating shutter is shutting the supply opening.

FIG. 6(*a*) illustrates a state in which the developing tank is set on the development device with the rotating shutter opening the supply opening, and FIGS. 6(*b*) and 6(*c*) illustrate a state in which the developing tank is drawn out from the set position of the development device, and the rotating shutter is shutting the supply opening.

FIG. 8(*a*) illustrates a straight member and a rotating member in a state in which a projection is engaged at a start-end of a spiral slot. FIG. 8(*c*) illustrates the straight member and the rotating member in a state in which the projection is engaged at a terminal-end of the spiral slot. FIG. 8(*b*) illustrates an intermediate of these two states.

FIG. 9(*a*) illustrates the straight member and the rotating member in a state in which the tip of the convex section is notch-engaged. FIG. 9(*c*) illustrates the straight member and the rotating member in a state in which the convex section is completely fit in the notch. FIG. 9(*b*) illustrates an intermediate of these two states.

FIG. 11(*a*) illustrates a direction of the rotating shutter in which the interlocking section is pressured, and FIG. 11(*b*) illustrates the direction of the rotating shutter in which the interlocking section is not pressured.

FIG. 13(*a*) illustrates a state in which the rotating shutter equipped in the development device is opening the supply opening, and FIG. 13(*b*) illustrates a state in which the rotating shutter is shutting the supply opening.

FIG. 14(*a*) illustrates a state in which the rotating shutter equipped in the development device is opening the supply opening, and FIG. 14(*b*) illustrates a state in which the rotating shutter is shutting the supply opening.

FIG. 15(*a*) illustrates a state in which the rotating shutter equipped in the development device is opening the supply opening, and FIG. 15(*b*) illustrates a state in which the rotating shutter is shutting the supply opening.

DESCRIPTION OF THE EMBODIMENTS

First Embodiment

One embodiment referring to FIGS. 1 to 11 is described below. The embodiment described below is one detailed example, and does not limit the scope of the technology.

Figure 2:
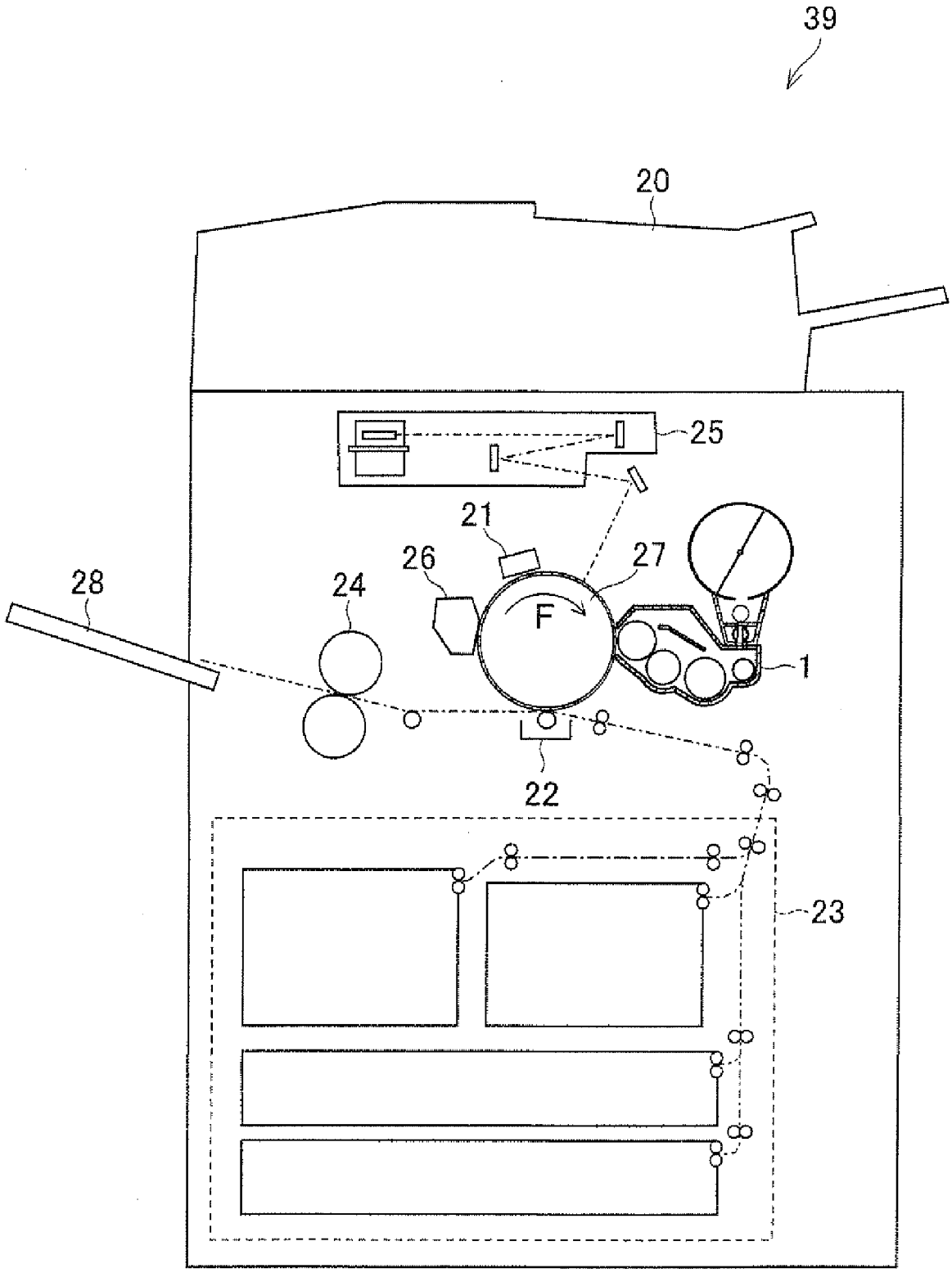
FIG. 2 is an explanation view briefly illustrating an overall structure of the image forming apparatus equipped with the development device.

Firstly the overall structure of an image forming apparatus 39 of an electrophotography printing method is described referring to FIG. 2. The image forming apparatus 39 includes a development device 1 in one embodiment. FIG. 2 is a brief explanation view of the overall structure of the image forming apparatus 39.

The image forming apparatus 39 includes a photoreceptor 27. A charging device 21, an exposure device 25, a development device 1, a transfer device 22 and a cleaning device 26 are arranged around the photoreceptor 27.

The photoreceptor 27 is of a drum-shape having a photoconductive material on its surface, and is rotated in a direction indicated by the arrow F. The charging device 21 evenly (uniformly) charges the surface of the photoreceptor 27.

The exposure device 25 exposes light to the surface of the charged photoreceptor 27 based on the pixel data, thereby to form an electrostatic latent image. The exposure device 25 may be, but not limited to, a laser scanning unit (LSU) including a laser irradiation section and a reflection mirror, or for example an EL or LED writing head having light-emitting elements arranged in an array-shape or the like.

The development device 1 forms a toner image (visible image) by developing the electrostatic latent image formed on the photoreceptor 27 with a two component developer including a toner and a carrier. The details of the development device 1 will be described later.

The transfer device 22 transfers the toner image on the photoreceptor 27 on a sheet (printing material) fed and carried from a paper feeding unit 23. A bias voltage of the opposite polarity to that of the toner is applied to the transfer device 22. The cleaning device 26 removes toner remained on the photoreceptor 27 after the transferring of the image to the sheet.

In addition, a fixing device 24 is provided in the downstream of the carrying direction of the sheet to which the toner image is transferred by the transfer device 22.

The fixing device 24 includes a heat roller and a pressure roller abutting each other. By passing the sheet to a nip section therebetween, the toner image is fixed onto the sheet. The sheet with the toner image fixed thereon by the fixing device 24 is discharged to a paper output tray 28.

FIG. 2 illustrates a monochrome image forming apparatus including one photoreceptor 27 as the image forming apparatus 39, as an example. However, the image forming apparatus may be a color image forming apparatus of a tandem type equipped with a plurality of photoreceptors, or a color image forming apparatus of a multiple rotation type equipped with a plurality of development devices surrounding one photoreceptor. The structure of the image forming apparatus including the development device 1 is not limited to the structure of FIG. 2.

Figure 1:
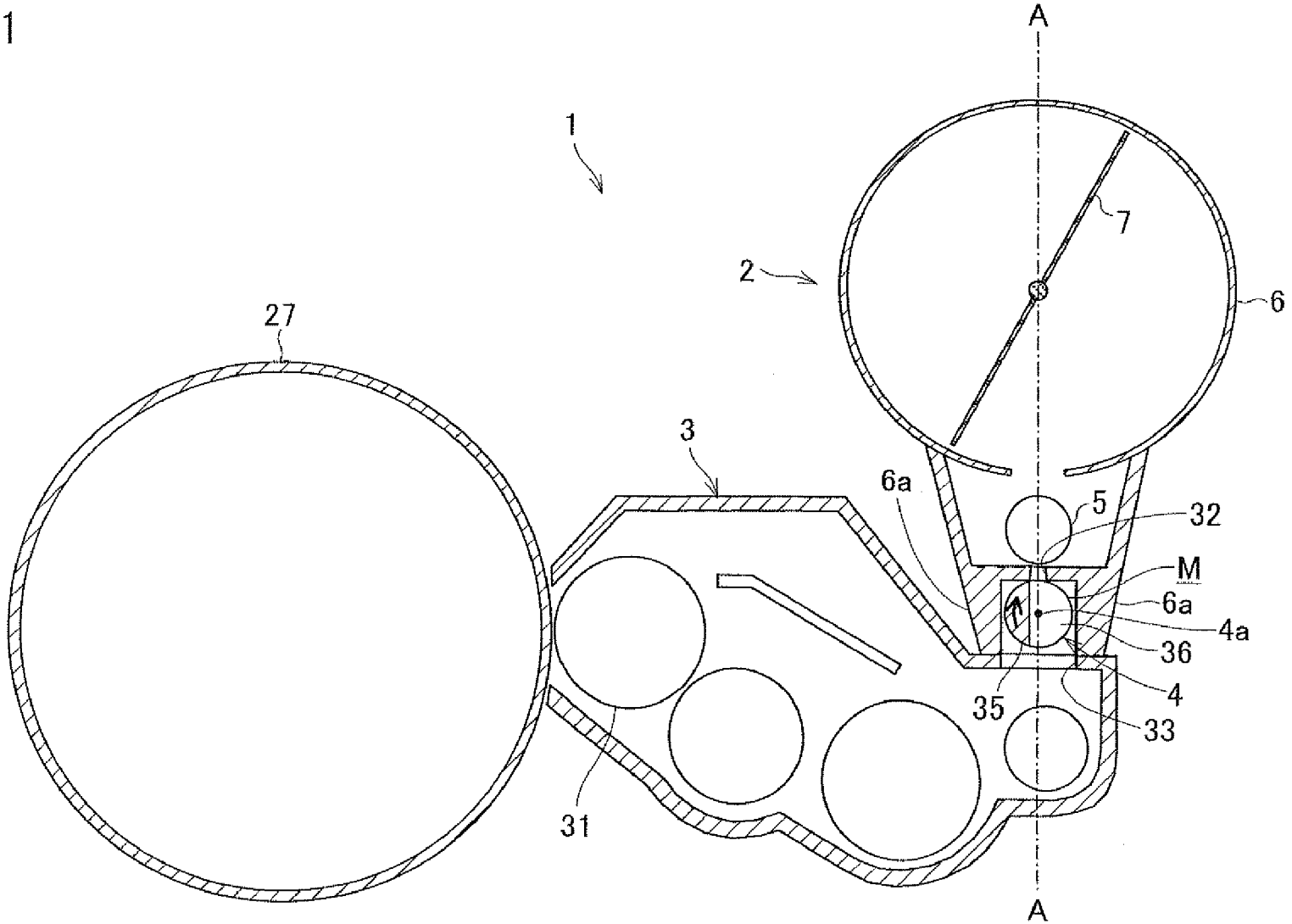
FIG. 1 is a front sectional view illustrating the structure of a development device and the surroundings thereof of a First Embodiment.
Figure 3:
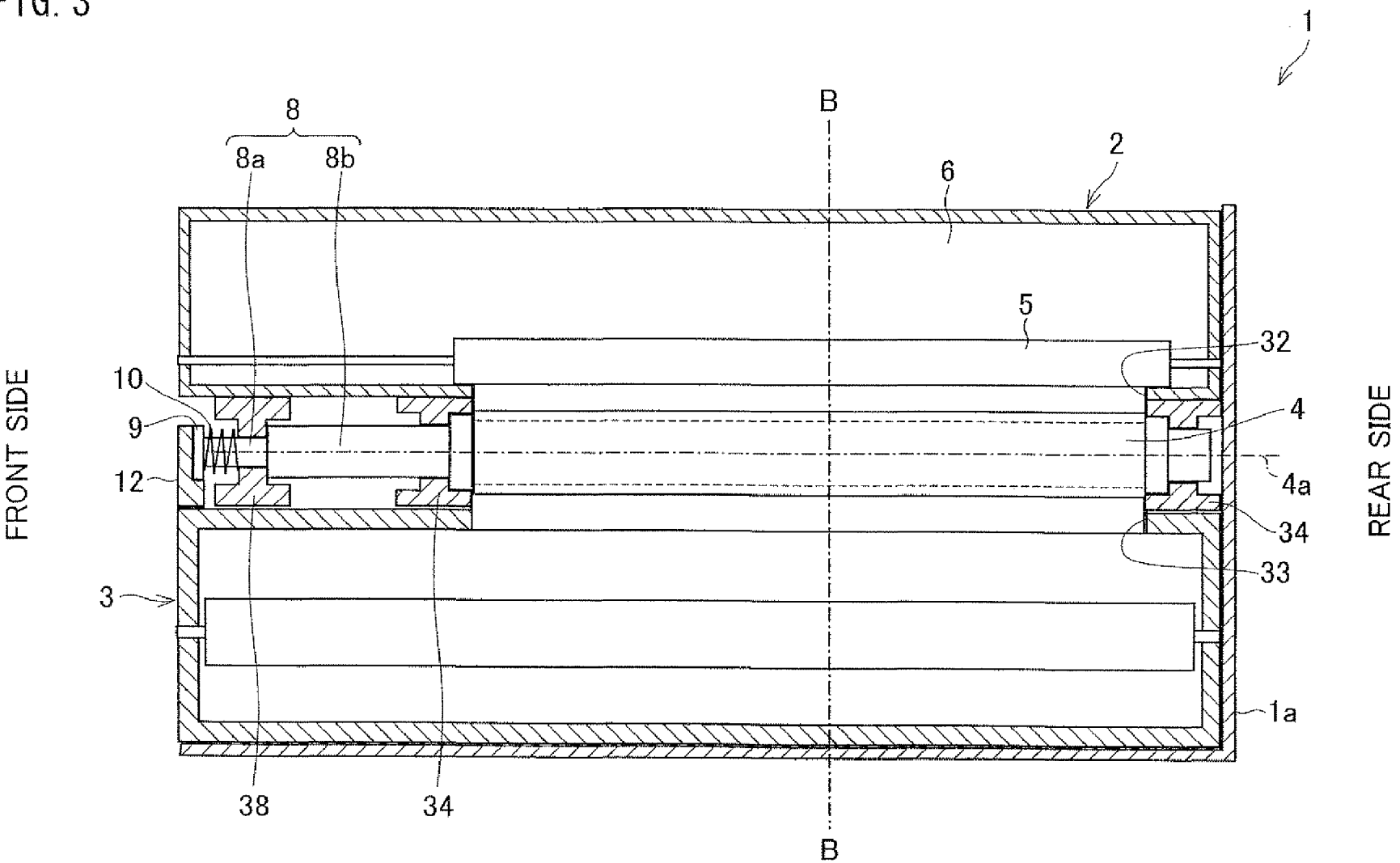
FIG. 3 is a side sectional view of the development device.

Next, a brief structure of the development device 1 being provided in the image forming apparatus 39 is explained as follows, referring to FIGS. 1 and 3. FIG. 1 is a front sectional view illustrating the structure of the development device 1, and FIG. 3 is a side sectional view of the development device 1. FIG. 3 is the cross sectional view taken on line A-A in FIG. 1, and FIG. 1 is the cross sectional view taken on line B-B in FIG. 3.

As illustrated in FIG. 1 and FIG. 3, the development device 1 includes a developing tank 3 and a toner supply device 2. The developing tank 3 contains a two component developer including a toner and a carrier. The toner supply device 2 contains the toner for supplying, and supplies the toner to the developing tank 3 when necessary.

The developing tank 3 and the toner supply device 2 are supported by a housing 1*a* of the development device 1 as illustrated in FIG. 3. The developing tank 3 is detachably arranged, but not the toner supply device 2. The developing tank 3 is detached from the development device 1 by being drawn out from the rear side to the front side, and is attached by being pushed in from the front side to the rear side. The housing 1*a* of the development device 1 is fixed to the image forming apparatus 39.

As illustrated in FIG. 1, the developing tank 3 includes various members constituting the development section inside thereof. The members encompass: a development roller 31 which attracts the contained developer to an outer surface thereof magnetically, and provides the developer to the photoreceptor 27; a stirring screw to stir the contained developer; and the like.

In addition, the developing tank 3 has a receiving opening 33 on its upper wall where the toner supply device 2 is connected. The receiving opening 33 is for receiving the toner supplied from the toner supply device 2. The receiving opening 33 is an opening extending from the front side to the rear side of the developing tank 3, as illustrated in FIG. 3. The developing tank 3 can be drawn out in a longitudinal direction of the receiving opening 33, which is an axial direction of the rotating shutter (shutter member) 4 (described later).

On the other hand, the toner supply device 2 has a toner container 6 containing the toner therein. The toner container 6 is fixed to the housing 1*a* of the development device 1. Inside the toner container 6, a toner-stirring member 7 is provided to stir the toner so it does not aggregate, as illustrated in FIG. 1 (the toner stirring member 7 is omitted in FIG. 3).

In addition, the toner container 6 has, on its wall on the bottom side being connected to the developing tank 3, a supply opening 32 for supplying the contained toner to the developing tank 3. The supply opening 32 faces the receiving opening 33 of the developing tank 3. The supply opening 32 is also an opening which extends from the front side to the rear side, as illustrated in FIG. 3.

Furthermore, in the vicinity of the supply opening 32, a toner supply roller 5 and the rotating shutter 4 are provided facing each other with the supply opening 32 therebetween. The toner supply roller 5 is arranged inside the toner container 6, and controls the amount of toner being supplied from the toner container 6 to the development tank 3 by rotation speed. The toner supply roller 5 is arranged on the whole of the supply opening 32.

The rotating shutter 4 is arranged on the outside of the toner container 6, and performs the opening and shutting of the supply opening 32. The rotating shutter 4 is arranged to perform the opening and shutting operations of the supply opening 32 in conjunction with the attachment and detachment operation of the developing tank 3. The supply opening 32 opens when the developing tank 3 is loaded in the development device 1, and the supply opening 32 shuts when the developing tank 3 is drawn out of the development device 1. The rotating shutter 4 will be described in detail later.

The rotating shutter 4 is also arranged for the whole of the supply opening 32, similarly to the toner supply roller 5, and is rotatably supported by bearings 34 fixed to the blocking wall of the toner container 6. FIG. 3 indicates the rotating center 4*a* of the rotating shutter 4 with a two-dot chain line.

The blocking wall of the toner container 6 is extended to the receiving opening 33 of the developing tank 3, as to cover both sides of the rotating shutter 4 in the axial direction. The toner supply device 2 and the developing tank 3 are connected by these extended sections 6*a* and bearings 34.

A space section formed by the extended sections 6*a* and bearings 34 form a communicating chamber M for communicating the inside of the developing tank 3 and the inside of the toner container 6, through the receiving opening 33 and the supply opening 32. The rotating shutter 4 is provided in the communicating chamber M.

Figure 4A:
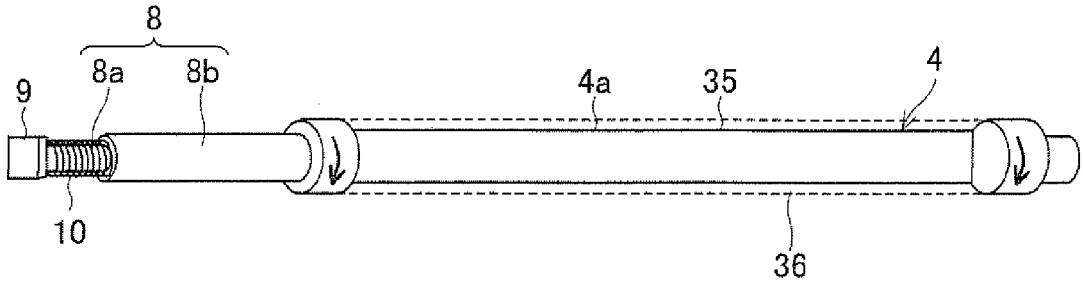
FIGS. 4(*a*) and 4(*b*) are perspective views of a rotating shutter and an interlocking section connected to the rotating shutter.
Figure 4B:
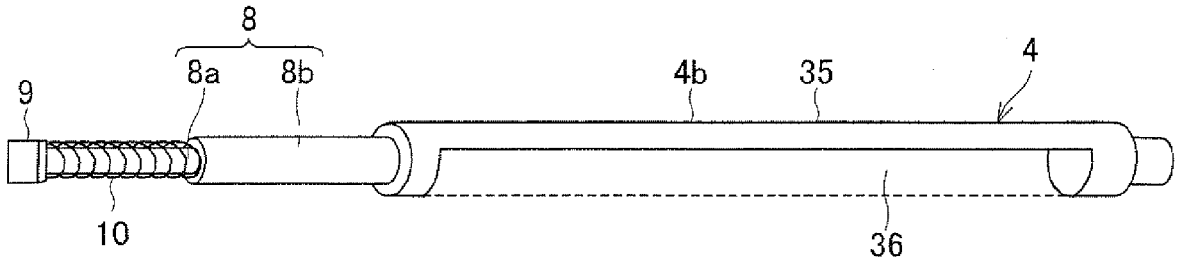
Figure 5A:
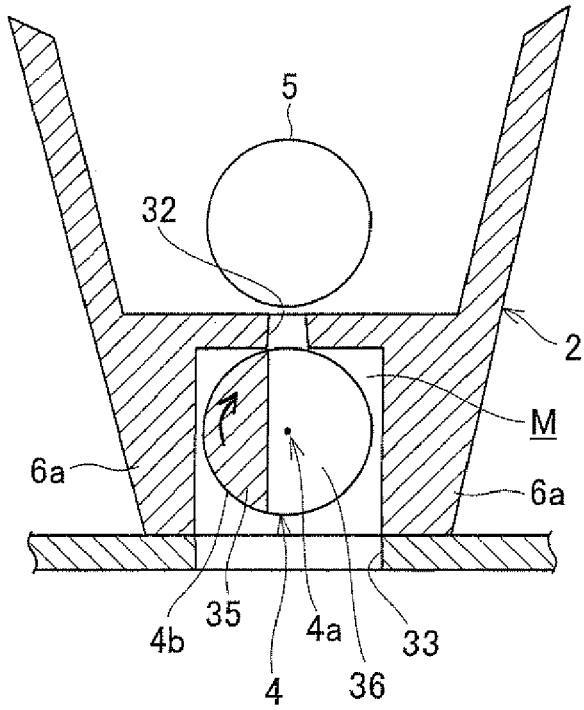
FIGS. 5(*a*) and 5(*b*) are partial sectional views of the development device.
Figure 5B:
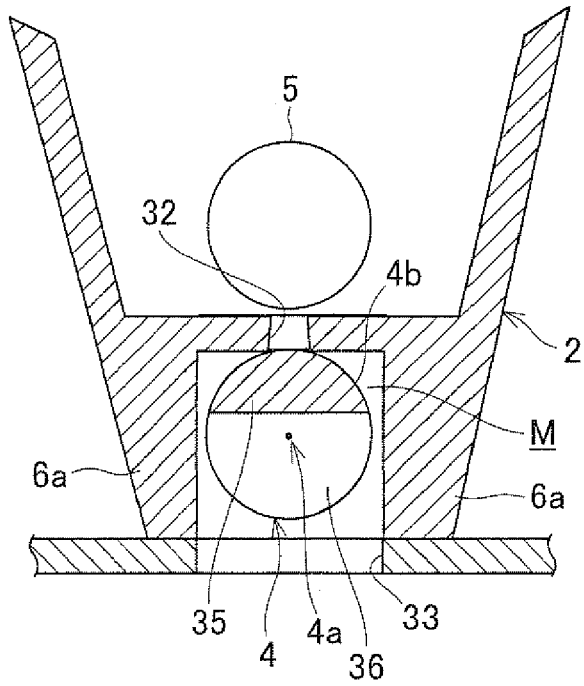

Next, the structure of the rotating shutter 4 is explained in detail, referring to FIGS. 4(*a*), 4(*b*), 5(*a*) and 5(*b*). FIGS. 4(*a*) and 4(*b*) are perspective views of the rotating shutter 4 illustrated in FIG. 1 with an interlocking section 8 (described later) connected to the rotating shutter 4. FIGS. 5(*a*) and 5(*b*) are partial sectional views of the development device 1 with the rotating shutter opening or shutting the supply opening 32.

As illustrated in FIGS. 4(*a*) and 4(*b*), the rotating shutter 4 has a roller-shaped (cylindrical) main section, and has an open section 36 therein. The open section 36 is extended in the axial direction and also opened in the direction perpendicular to the axial direction thereof. In other words, the rotating shutter has a shape with mostly the entire outer surface of the roller-shaped main section cut off, thereby leaving only a part of the outer surface of the roller-shaped main section in the axial direction. Consequently, a half-cylindrical part having an outer surface of the roller-shaped main section extending in the axial direction with a cross-section of the direction perpendicular to the axial direction in a semicircle-shape forms the shutting section 35, which covers and shuts the supply opening 32.

As illustrated in FIG. 5(*a*), the rotating shutter 4 opens the supply opening 32 by communicating the supply opening 32 and the receiving opening 33 through the open section 36. In order to communicate the openings, the shutting section 35 is made standing upright along the extended sections 6*a* in the communicating chamber M, whereby the open section 36 faces the supply opening 32.

The open section 36 is preferably formed such that the blocking of the supplying opening 32 by the open section 36 is minimized. This is because the open section 36 is formed to let the toner pass therethrough from the supply opening 32. However, the open section 36 larger in size leads to poor rigidity of the rotating shutter 4. Therefore, in order to enhance the rigidity of the rotating shutter 4, the open section 36 may be small to the extent that the passing of the toner is not interfered, or the rotating shutter 4 may be reinforced with a bridge or the like.

In addition, as illustrated in FIG. 5(*b*), the rotating shutter 4 shuts by having the shutting section 35 face the supply opening 32, and cover the supply opening 32 with the outer surface of the roller-shaped main section. As such, the shutting section 35 is necessary in order to shut the supply opening 32. Therefore, the area in a radial direction on the outer surface of the aforementioned shutting section 35 obviously requires a larger area than the supply opening 32.

The rotating shutter 4 is preferably made of a resin material including an electrically conductive material. The resin material (for example, ABS, polyethylene polycarbonate, resin, or the like) has sufficient strength and is easily molded, however has a disadvantage that static electricity readily accumulates. By adding the electrically conductive material in the resin material, triboelectric charging is less likely to occur with the toner. Thus, the adhering of the electrostatically-charged toner on the inside of the rotating shutter 4 caused by electrostatic force can be prevented, since the supplied toner is less likely to be charged by the friction between the rotating shutter. Generally, a carbon black or conductive titanic oxide may be used as the electrically conductive material.

It is preferable that the surface of the rotating shutter 4 has a ten-point height of irregularity Rz of not more than 2 micron, and it is further preferable that the Rz of the surface of the rotating shutter 4 is not more than 1 micron. By using these rotating shutters 4 with high smoothness, the attachment of the toner on the surface of the rotating shutter 4 can be prevented even if the toner receives stress. The smoother the surface of the rotating shutter 4 is the better. Thus, the minimum limit of the Rz is 0 micron.

The ten-point height of irregularity Rz is calculated according to the JIS standard B0601-1994. According to the standard, the ten-point height of irregularity is a sum of an average of absolute values of heights of a highest hill to a 5th highest hill within a standard length, and the average of the absolute values of the depth from a deepest valley to a 5th deepest valley within the standard length.

Figure 6A:
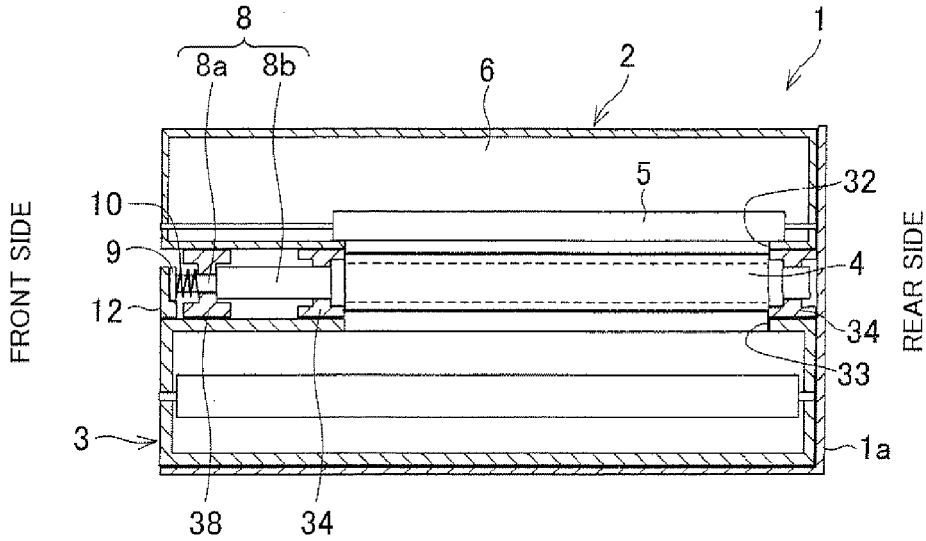
FIGS. 6(*a*) to 6(*c*) are side sectional views of the development device.
Figure 6B:
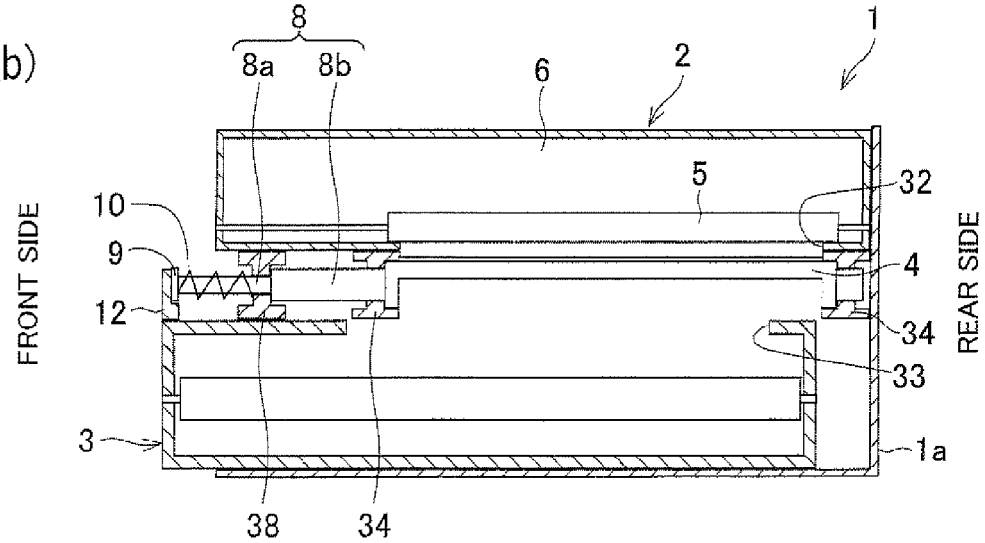
Figure 6C:
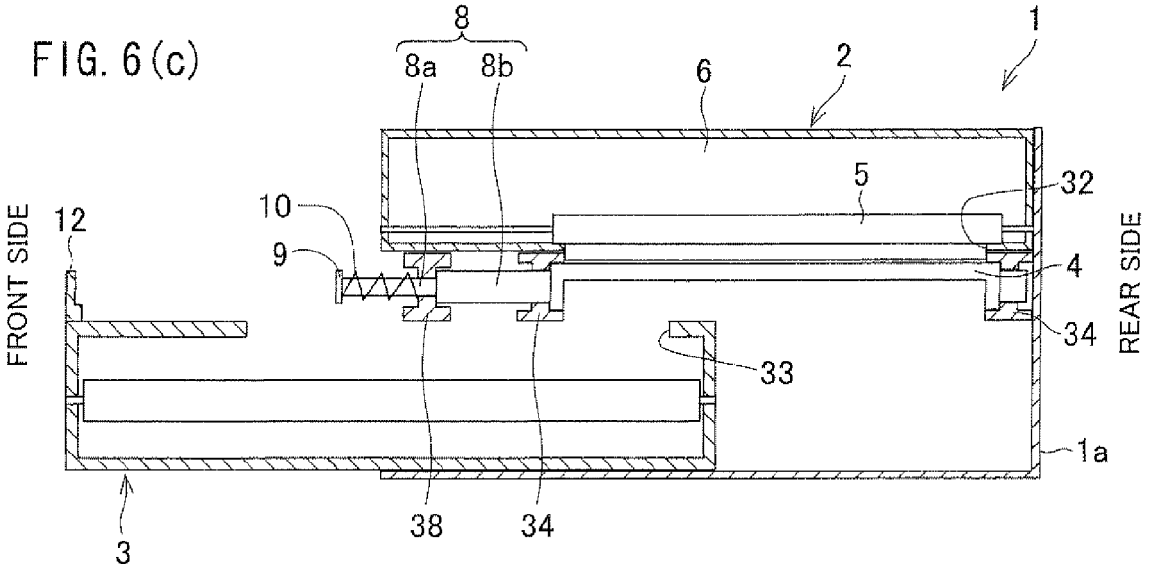

Next, the structure in which the opening and shutting operation of the supply opening 32 of the rotating shutter 4 in conjunction with the attachment and detachment of the developing tank 3 is detached or attached is explained as below, referring to FIGS. 4(*a*), 4(*b*), and 6(*a*) to 6(*c*). FIG. 6(*a*) illustrates the state in which the developing tank 3 is set in the development device 1, and with the rotating shutter 4 opening the supply opening 32. FIGS. 6(*b*) and 6(*c*) illustrate the state in which the development tank 3 is drawn out from the set position of the development device 1, and the rotating shutter 4 is shutting the supply opening 32.

As above, in the development device 1 of the present embodiment, the opening and shutting operation of the supply opening 32 by the rotating shutter 4 is performed in conjunction with the attachment and detachment operation of the developing tank 3. This is made possible by the interlocking section 8.

As illustrated in FIGS. 4(*a*) and 4(*b*), the interlocking section 8 is provided on one end of the rotating shutter 4, and has a straight member 8*a* of a substantially unhollowed cylindrical and a rotating member 8*b* of a substantially hollow cylindrical. The straight member 8*a* performs a straight-line movement. The straight member 8*a* has one end engaged with the rotating member 8*b*, and an abutting section 9, which is formed on the other end. The straight member 8*a* is pushed in the inside of the rotating member 8*b*, being caused by the abutting section 9 pressured in the axial direction as illustrated in FIG. 4(*a*).

In addition, the interlocking section 8 has a spring 10 arranged between the abutting section 9 and the rotating member 8*b*. Inside a spiral of the spring 10, the straight member 8*a* is provided. The spring 10 is in a compressed state when the straight member 8*a* is pushed in the inside of the rotating member 8*b* by the abutting section 9 being pushed. When the pressure towards the abutting section 9 is released from such state, the spring 10 is sprung back as illustrated in FIG. 4(*b*), trying to return to the original state. The abutting section 9 is then pushed to the opposite direction of the pressured direction caused by the spring-back of the spring 10. Thus, force is added in the direction to pull out towards the straight member 8*a* from the rotating member 8*b*, and the straight member 8*a* is drawn out from the rotating member 8*b*.

That is to say, the straight member 8*a* is arranged such that a reciprocation is performed, in which the straight member 8*a* is pushed inside the rotating member 8*b* when the abutting section 9 is pressed, and is drawn out from the inside of the rotating section 8*b* when the pressure given to the abutting section 9 is released.

The rotating member 8*b* performs a rotation movement effected by the straight-line movement of the straight member 8*a*. The rotating member 8*b* rotates by 90 degrees according to the movement of the straight member 8*a* being drawn out as illustrated in FIG. 4(*b*), from the state in which the straight member 8*a* is pushed inside as illustrated in FIG. 4(*a*). By contrast, the rotating member 8*b* rotates by 90 degrees in the opposite direction of the aforementioned direction by having the straight member 8*a* being pushed in as illustrated in FIG. 4(*a*) from the state in which the straight member 8*a* is drawn out as illustrated in FIG. 4(*b*).

The rotating shutter 4 is connected with this rotating member 8*b*, and rotates together with the rotating member 8*b*. That is to say, the rotating shutter 4 takes the state in which the supply opening 32 is opened with the shutting section 35 standing as illustrated in FIG. 5(*a*), when the abutting section 9 is pushed as illustrated in FIG. 4(*a*). On the other hand, as illustrated in FIG. 4(*b*), in the state in which the abutting section 9 is not pushed, the rotating shutter 4 takes the state in which the supply opening 32 is shut with the rotating shutter 4 being rotated by 90 degrees from the state illustrated in FIG. 5(*a*), as illustrated in FIG. 5(*b*), with the shutting section 35 facing upwards.

Whether or not the pressure is given towards the abutting section 9, which determines the opening and shutting of the supply opening 32, is determined from the setting state of the developing tank 3. The abutting section 9 is arranged such that it is to be abutted with the abutting plate 12 provided on the sidewall on the front side of the developing tank 3, as illustrated in FIG. 6(*a*). Therefore, in the state in which the developing tank 3 is set in the development device 1, the abutting section 9 is pushed by the abutting plate 12, resulting in the straight member 8*a* being pushed inside the rotating member 8*b*, and the rotating shutter 4 opens the supply opening 32.

On the other hand, when the developing tank 3 is drawn out from the set position, the pressure from the abutting plate 12 to the abutting section 9 is released as illustrated in FIGS. 6(*b*) and 6(*c*). As a result, the straight member 8*a* is drawn out from the rotating member 8*b* effected by the spring-back of the compressed spring 10, and the rotating shutter 4 shuts the supply opening 32. It is possible in such a mechanism, to open and shut the rotating shutter 4 in conjunction with the attachment and detachment operation of the developing tank 3.

Furthermore, in the above structure, the straight member 8*a* and the rotating member 8*b* are arranged concentrically with the rotating shutter 4, and the rotating center of the rotating member 8*b* is concentric with the rotating center 4*a* of the rotating shutter 4. With this arrangement, the rotating shutter 4 which opens and shuts the supply opening 32 in conjunction with the attachment and detachment operation of the developing tank 3 may be compact with eliminating any wasting space, and allows the development device itself to be compact.

In the explanation using FIGS. 4(*a*) and 4(*b*), the spring 10 is provided between the abutting section 9 and the rotating member 8*b* in the interlocking section 8. However, strictly speaking, the straight member 8*a* is supported by a bearing 38 fixed to the wall of the toner container 6, and the spring 10 is arranged between the bearing 38 and the abutting section 9. In addition, the spring 10 was arranged embracing the straight member 8*a* in the aforementioned structure, however the spring 10 may also be arranged inside the rotating member 8*b*.

A mechanism in which the rotating member 8*b* rotates by the straight member 8*a* being pushed in or drawn out in the interlocking section 8 is explained in detail as follows, referring to FIGS. 7 and 8(*a*) to 8(*c*).

Figure 7:
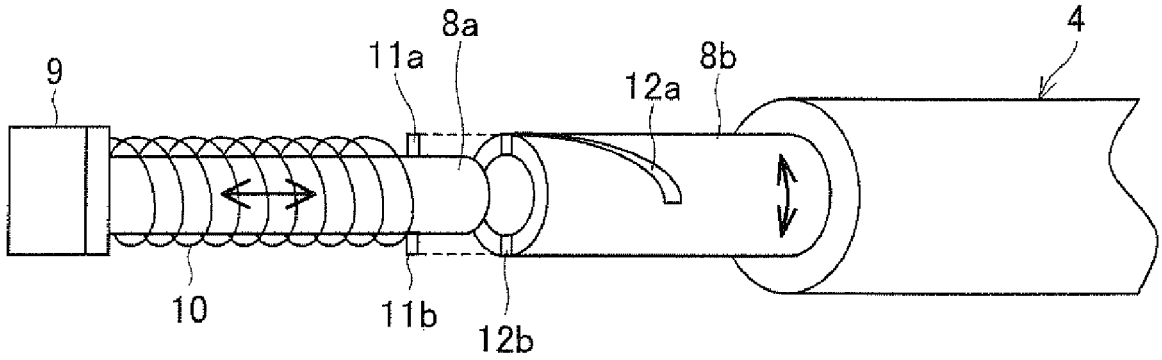
FIG. 7 is an exploded perspective view of the interlocking section of the development device.

FIG. 7 is an exploded perspective view of the interlocking section 8 in the development device 1. As illustrated in FIG. 7, two projections 11*a* and 11*b* are formed on the edge of the outer surface of the straight member 8*a*, on the side being engaged with the rotating member 8*b*. On the side engaging with the straight member 8*a* on the rotating member 8*b*, spiral slots (engaging section) 12*a* and 12*b* engaging with the projections 11*a* and 11*b* are formed. The spiral slots 12*a* and 12*b* are designed such that the rotating member 8*b* and the straight member 8*a* relatively rotate by 90 degrees, by having the projections 11*a* and 11*b* move from the start-end to the terminal-end of the spiral slots 12*a* and 12*b*.

Figure 8A:
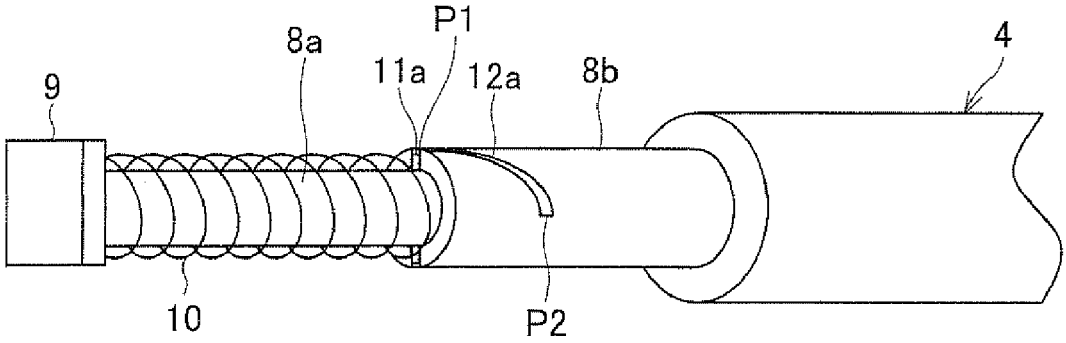
FIGS. 8(*a*) to 8(*c*) are explanation views illustrating an operation of the interlocking section.
Figure 8B:
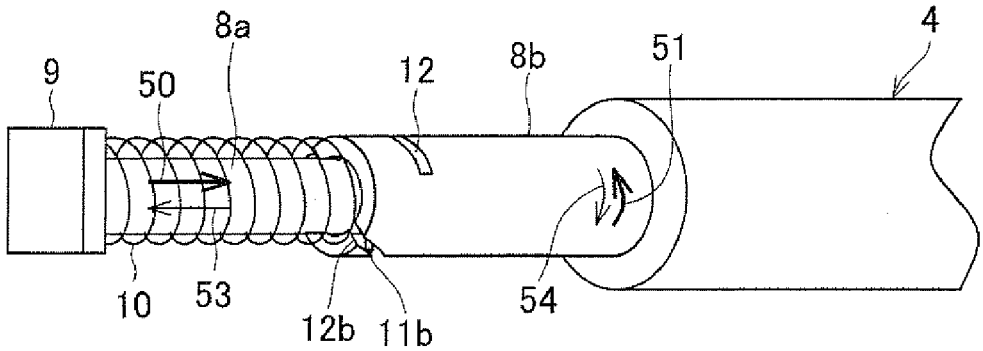
Figure 8C:
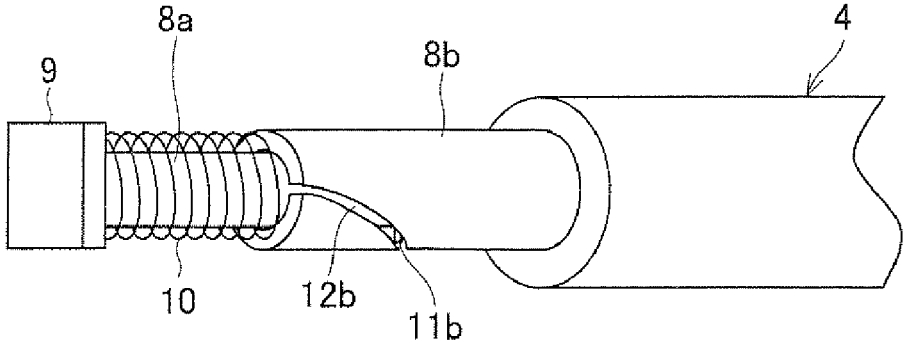

FIG. 8(*a*) illustrates the straight member 8*a* and the rotating member 8*b* in the state in which the projections 11*a* and 11*b* are engaged at the start-end P1 of the spiral slots 12*a* and 12*b*. FIG. 8(*c*) illustrates the straight member 8*a* and the rotating member 8*b* in the state in which the projections 11*a* and 11*b* are engaged at the terminal-end P2 of the spiral slots 12*a* and 12*b*. FIG. 8(*b*) illustrates the intermediate of these two states.

As illustrated in FIGS. 8(*a*) and 8(*b*), the projections 11*a* and 11*b* move toward the rear side of the rotating member 8*b* with accordance to the straight member 8*a* being pushed in the rotating member 8*b* and moving in the direction indicated by the thick arrow 50. Consequently, the projections 11*a* and 11*b* try to move along the spiral slots 12*a* and 12*b*, however the straight member 8*a* is arranged such that it does not rotate. Therefore, the rotating member 8*b* having the spiral slots 12*a* and 12*b* rotates in the direction indicated by the thick arrow 51, so not to interfere with the movement of the projections 11*a* and 11*b* moving in a straight direction.

When the projections 11*a* and 11*b* reach the terminal-end P2 of the spiral slots 12*a* and 12*b* and stop, the rotation of the rotating member 8*b* also stops. Here, the rotation member 8*b* stops in the state in which it is rotated by 90 degrees around the straight member 8*a*.

On the opposite, when the straight member 8*a* is drawn out from the rotating member 8*b* and moves in the direction indicated by the thin arrow 53 as illustrated in FIG. 8(*b*), the rotating member 8*b* rotates in the direction indicated by the thin arrow 54. Consequently, when the projections 11*a* and 11*b* reach the start-end P1 of the spiral slots 12*a* and 12*b* and stops as illustrated in FIG. 8(*a*), the rotating member 8*b* also stops its rotation.

As such, the rotating member 8*b* can be reversibly rotated in the structure, so as to move in the direction of pushing the straight member 8*a* into the rotating member 8*b* and reversely in the direction of drawing the straight member 8*a* out from the rotating member 8*b*.

In the moving of the projections 11*a* and 11*b* on the spiral slots 12*a* and 12*b*, it is necessary that the straight member 8*a* is unrotatable, as described above. This is because the rotating member 8*b* will not be able to rotate if the straight member 8*a* itself rotates. In the present embodiment, the straight member

8*a* is arranged such that the straight member 8*a* does not rotate by having the abutting section 9 of the straight member 8*a* engage with the abutting plane 12 of the developing tank 3, however the technology is not particularly limited to this method. In addition, the embodiment arranged two pairs of the projection 11 and the spiral slot 12, however the number of pairs is not particularly limited, that is to say, there may be one pair, or there may be three or more pairs.

Furthermore, in the interlocking section 8, the mechanism such that the rotating member 8*b* rotates by being effected by the straight member 8*a* being pushed in or drawn out is not limited to the aforementioned structure of the projections 11*a*, 11*b* and the spiral slots 12*a*, 12*b*, or other structures. For example, FIGS. 9(*a*) to 9(*c*) may also be considered.

Figure 9A:
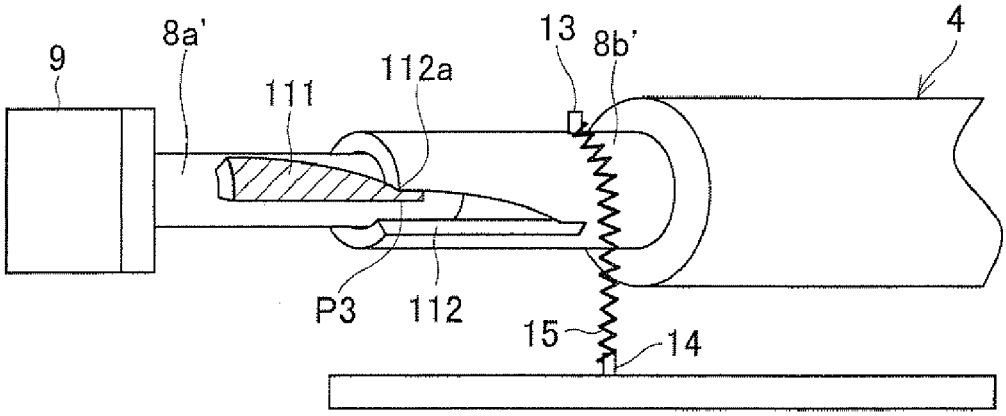
FIGS. 9(*a*) to 9(*c*) are explanation views illustrating an operation of the interlocking section employing other mechanisms to rotate the rotation member in accordance with the movement of the straight member.
Figure 9B:
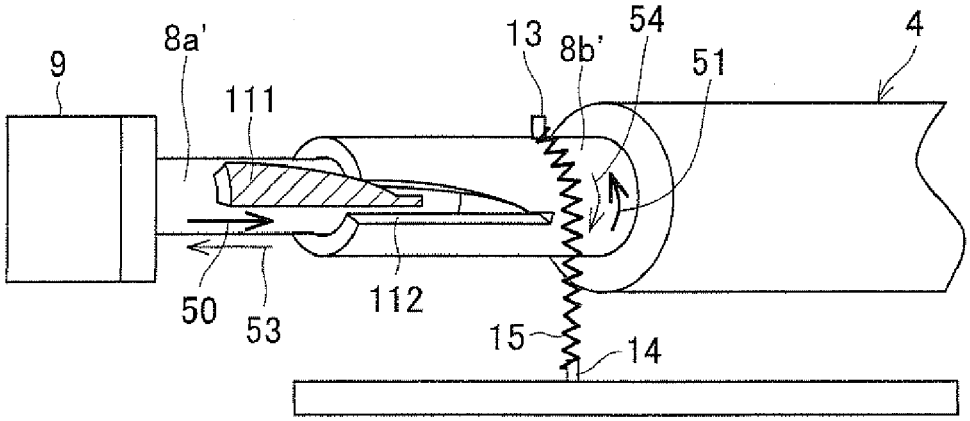
Figure 9C:
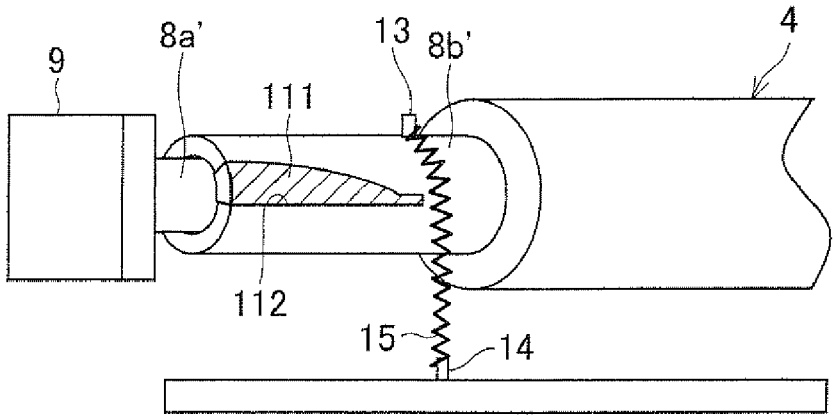

FIGS. 9(*a*) to 9(*c*) are perspective views of the interlocking section 8 adopting another mechanism, in which a rotating member 8*b*' rotates in accordance with the movement of a straight member 8*a*'. On the outer surface of the straight member 8*a*', a triangular convex section 111 with one side expanding in the circumferential direction is formed as illustrated in FIG. 9(*a*). On the other hand, the rotating member 8*b*' has a triangular notch 112 which the convex section 111 matches, on the side engaging with the straight member 8*a*, and the outer surface of the rotating member 8*b*' has a projection 13 fixing one end of a spring 15.

The spring 15 has one end fixed to the projection 13 formed on the rotating member 8*b*', and the other end fixed to a projection 14 arranged on the inner wall surface of the toner supply device 2. The spring 15 pressures the side expanding towards the circumferential direction of the convex section 111 against the side expanding to the circumferential direction of the notch 112.

FIG. 9(*a*) illustrates the state of the straight member 8*a*' and the rotating member 8*b*' when only the tip P3 of the convex section 111 is engaged with the notch 112. FIG. 9(*c*) illustrates the state of the straight member 8*a*' and the rotating member 8*b*' when the convex section 111 completely matches the notch 112. FIG. 9(*b*) illustrates the intermediate of these two states.

As illustrated in FIGS. 9(*a*) and 9(*b*), the straight member 8*a*' is pushed into the rotating member 8*b*', and in conjunction with the movement of the straight member 8*a*' in the direction indicated with the thick arrow 50, the convex section 111 moves to the rear of the notch 112. Consequently, the convex section 111 tries to move along the notch 112, however the straight member 8*a*' is made such that it does not rotate. Therefore, the rotating member 8*b*' of the side having the notch 112 rotates in the direction indicated by the thick arrow 51 without interfering with the straight-line movement of the convex section 111.

When the convex section 111 completely matches with the notch 112 as illustrated in FIG. 9(*c*), the rotation of the rotating member 8*b*' also stops. The rotating member 8*b*' stops in a state in which the rotating member 8*b*' is rotated by 90 degrees around the straight member 8*a*'.

In the opposite, when the straight member 8*a*' is drawn out from the rotating member 8*b*' from the state illustrated in FIG. 9(*c*), and moves in the direction indicated by the thin arrow 53 as illustrated in FIG. 9(*b*), the rotating member 8*b*' rotates in the direction indicated by the thin arrow 54. When the convex section 111 is drawn out from the notch 112 and engages at the start-end P1 as illustrated in FIG. 9(*a*), the rotation of the rotating member 8*b*' stops.

As above, the development device 1 of the present embodiment is arranged such that the rotating shutter 4 is supported rotatably between the supply opening 32 formed on the toner supply device 2 and the receiving opening 33 formed on the developing tank 3. The rotating shutter 4 has an open section 36 which extends in the axial direction of the roller-shaped main section and also opened in the direction perpendicular to the axial direction thereof, opening and shutting the supply opening 32 in conjunction with the attachment and detachment operation of the developing tank 3.

The rotating shutter 4 shuts the supply opening 32 by covering the supply opening 32 with the outer surface of the roller-shaped main section, and opens the supply opening 32 by communicating the supply opening 32 and the receiving opening 33 through the open section 36.

With this structure, the outer surface of the roller-shaped main section slides as to friction the supply opening 32 with the rotation of the rotating shutter 4. Thus, the toner adhesion is less likely to occur on the vicinity of the supply opening, compared to the door-type structure described in Patent Document 1.

Moreover, the outer surface of the roller-shaped main section has a curvature, and so the outer surface of the roller-shaped main section is tangent with the supply opening 32. Therefore, compared to the door-type structure of Patent Document 1 with the shutter having plane contact with the vicinity of the supply opening 32, the decrease in shielding function due to the adhered toner on the vicinity of the supply opening 32 is less likely to occur.

Furthermore, in the case of the door-type as described in Patent Document 1 or a structure sliding a sheet-shaped shutter, it is required to secure the space for the movement of the shutter. However, by making the rotating shutter 4 a roller-type, the opening and shutting of the supply opening can be performed by rotating in the same position. Therefore, the space required for the rotating shutter 4 can be small, which results to the downsizing of the development device 1, consequently the downsizing of the image forming apparatus 29 equipped with the development device 1.

Figure 10:
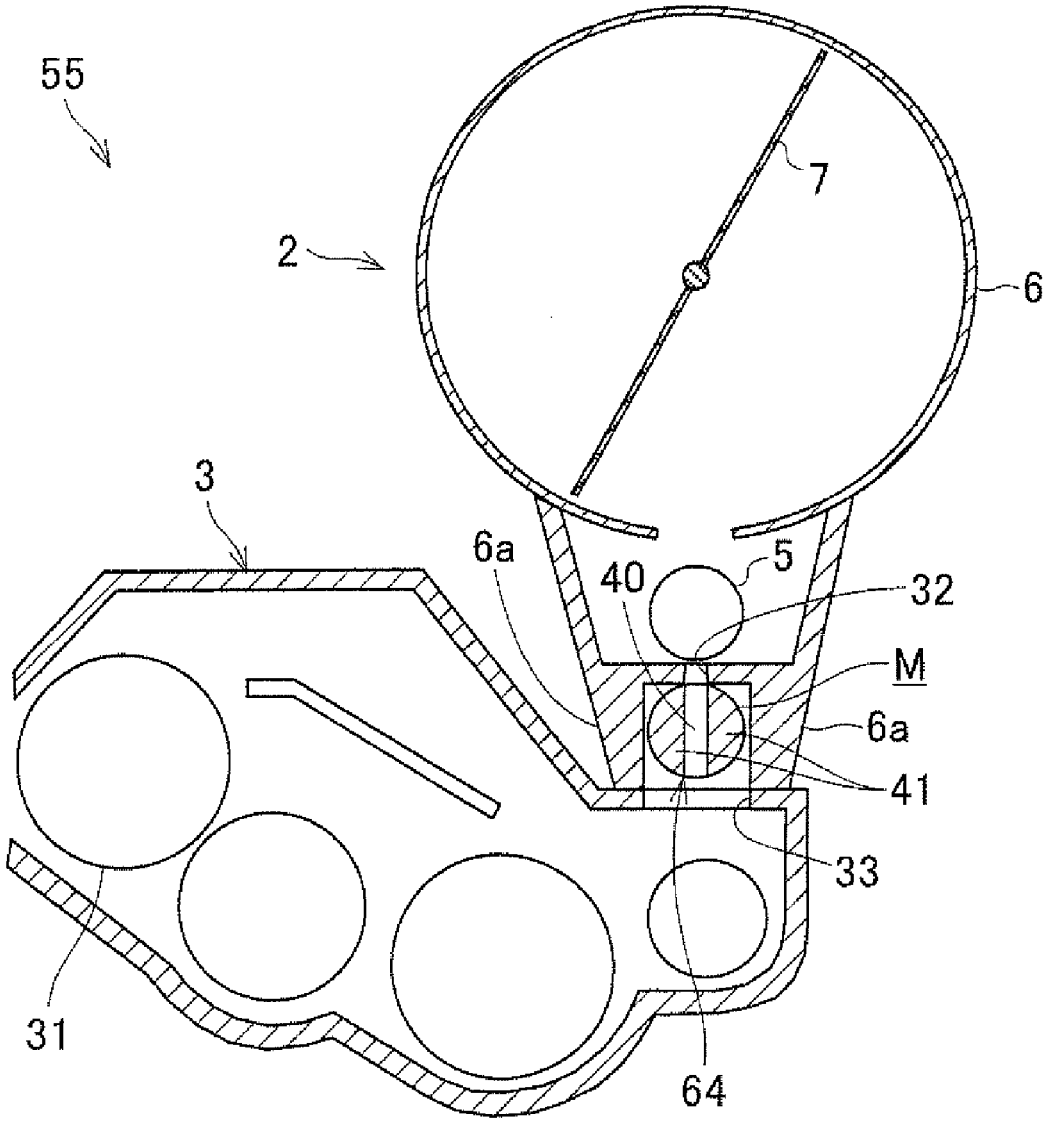
FIG. 10 illustrates a development device of a modification of the First Embodiment, and is a front sectional view illustrating the development device.
Figure 11A:
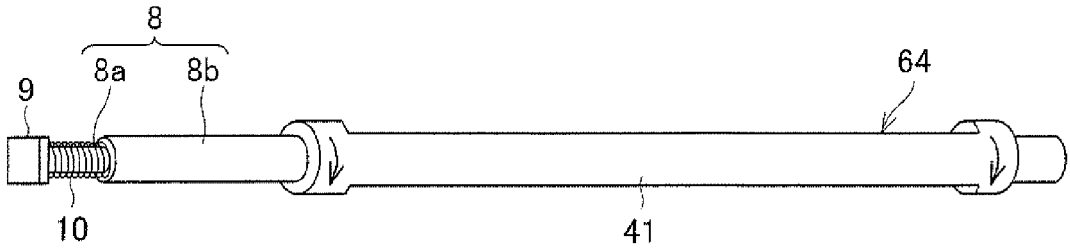
FIGS. 11(*a*) and 11(*b*) are perspective views of the rotating shutter and the interlocking section connected therewith, equipped in the developing device of the modification.
Figure 11B:
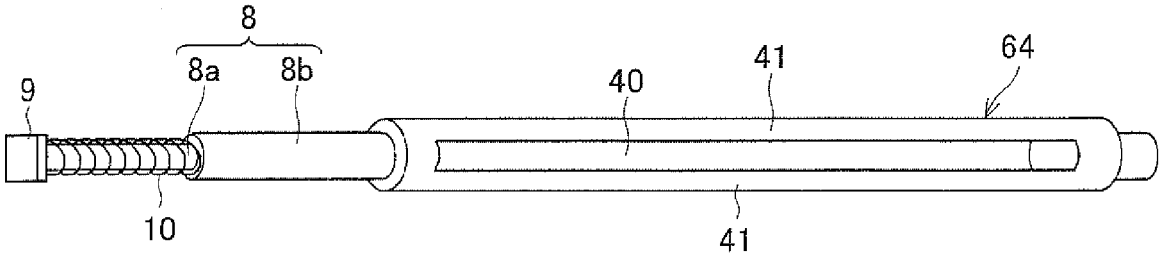

The shape of the rotating shutter 4 is not limited to the above, and may be a shape as illustrated in FIGS. 11(*a*) and 11(*b*). FIGS. 11(*a*) and 11(*b*) are perspective views of a rotating shutter 64 and the interlocking section 8 connected thereof. In addition, FIG. 10 is a front sectional view illustrating the structure of the development device 55 equipped with the rotating shutter 64 in the shape illustrated in FIGS. 11(*a*) and 11(*b*).

The rotating shutter 64 illustrated in FIG. 10 has an open section 40, being a through-hole with the cross-section on the direction perpendicular to the axial direction of the rotating shutter 64 (perpendicular direction of the rotating axis) in a rectangular shape so that the supplied toner from the supplied opening 32 directly falls into the developing tank 3. With this structure, two shutting sections 41 are formed facing each other as the shutting section 41 having the outer surface of the roller-shaped main section.

By directly dropping the toner being supplied from the supply opening 32 in the developing tank 3, the toner is less likely to adhere in the parts other than the shutting sections 41 of the rotating shutter 64. Thus, it is possible to make it difficult to accumulate the toner on the periphery of the rotating shutter 64. Therefore, it is possible to also reduce the dirtying of the apparatus caused by the dropping of the toner being adhered on the periphery of the rotating shutter 64.

The open section 40 being the through-hole is preferably formed such that it matches the shape of the supply opening 32, so not to interfere the passing of the toner. Thus, the open section 40 preferably has a shape which can completely expose the supply opening 32. However, as previously explained, there is the problem of rigidity, so the open section 40 may be small in size to the extent that the passing of toner is not interfered or reinforced with a bridge or the like.

Second Embodiment

The following is an explanation of another embodiment, referring to FIGS. 12 to 15. As a matter of convenience in explanation, members with the same functions as the members used in the First Embodiment have the same reference codes, and the explanations of those is omitted here.

Figure 12:
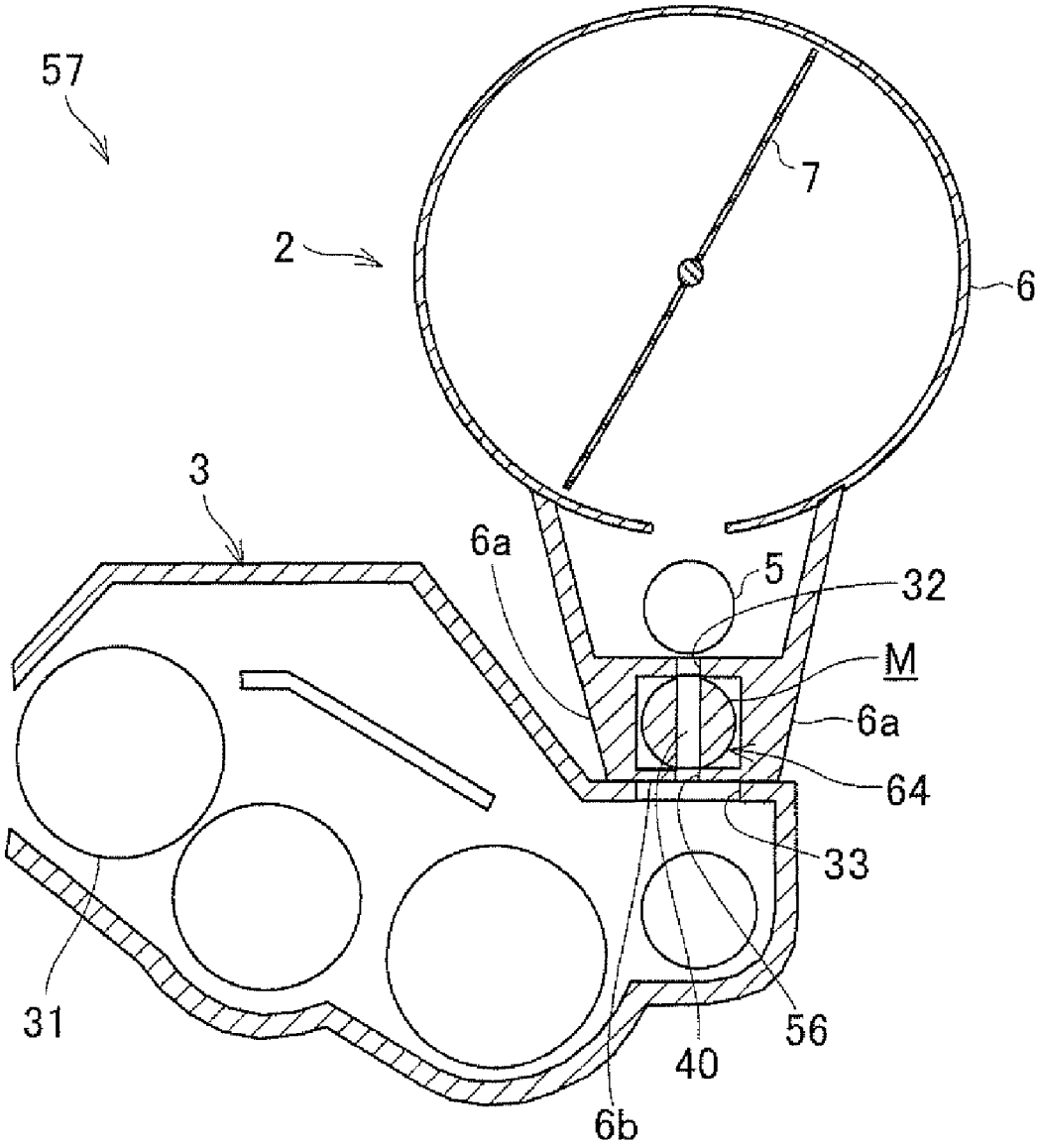
FIG. 12 is a front sectional view illustrating the development device of a Second Embodiment.

FIG. 12 is a front sectional view illustrating the structure of a development device 57 of the present embodiment. The difference between the development device 57 and the development device 55 in the aforementioned FIG. 10 is a discharge opening 56 provided in the communicating chamber M. The development device 57 has a blocking wall 6*b* in the communicating chamber M, located in the vicinity of the receiving opening 33, blocking the communicating chamber M from the receiving opening 33. The discharge opening 56 is formed on the blocking wall 6*b*. The communicating chamber M communicates to the developing tank 3 through the discharge opening 56 and the receiving opening 33.

Figure 13A:
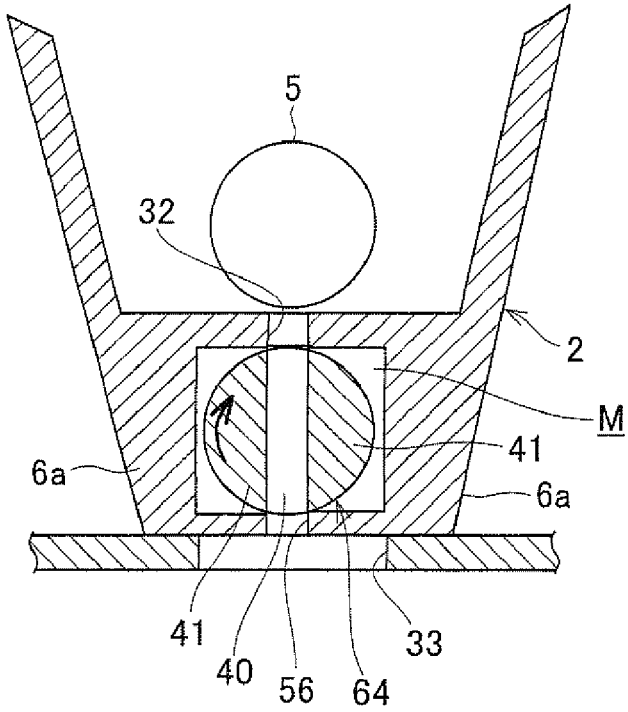
FIGS. 13(*a*) and 13(*b*) are partial sectional views of the development device in FIG. 12.
Figure 13B:
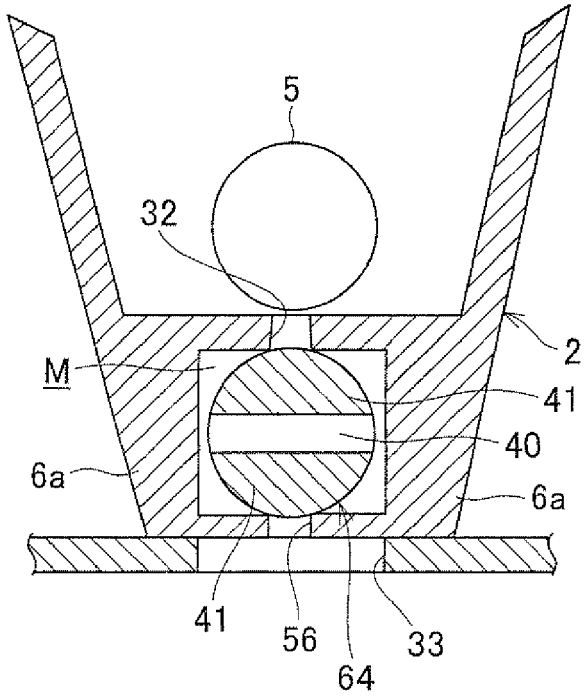

The rotating shutter 64 is structured such that one of the shutting sections 41 shuts the discharge opening 56 in the state in which the other shutting section 41 is shutting the supply opening 32, as illustrated in FIG. 13(*b*). FIGS. 13(*a*) and 13(*b*) are partial sectional views of the development device 57, illustrating the state in which the rotating shutter 64 is opening or shutting the supply opening 32, respectively.

As such, in the structure of the development device 57, when the supply opening 32 is shut, that is, when the developing tank 3 is drawn out from the apparatus (out of the image forming apparatus), not only the supply opening 32 but also the communicating chamber M itself containing the rotating shutter 64 is also shielded. As a result, the apparatus is less likely dirtied by the toner adhered within the rotating shutter 64 and the communicating chamber M.

In addition, in the structure, the open section 40 being a through-hole is preferably formed matching the shape of the supply opening 32 and the discharge opening 56 so not to interfere with the passing of the toner.

Figure 14A:
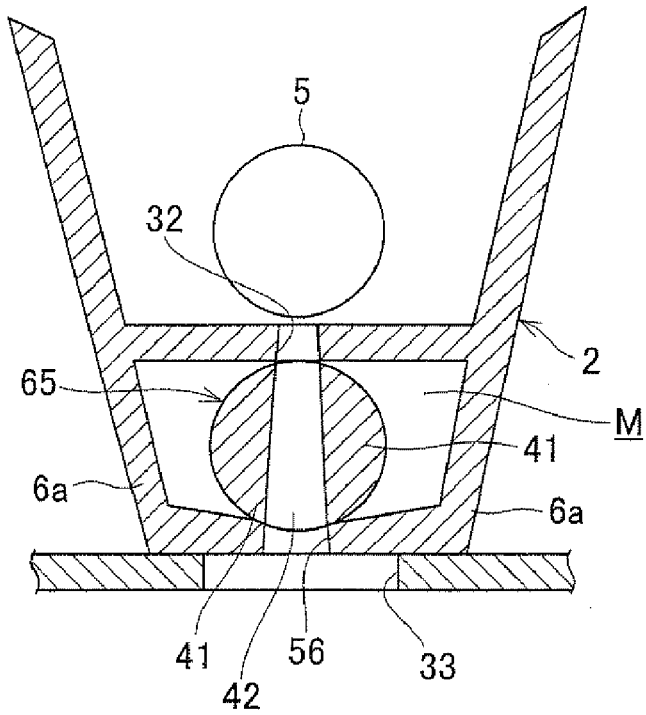
FIGS. 14(*a*) and 14(*b*) are partial sectional views of a modification of the development device of the Second Embodiment.
Figure 14B:
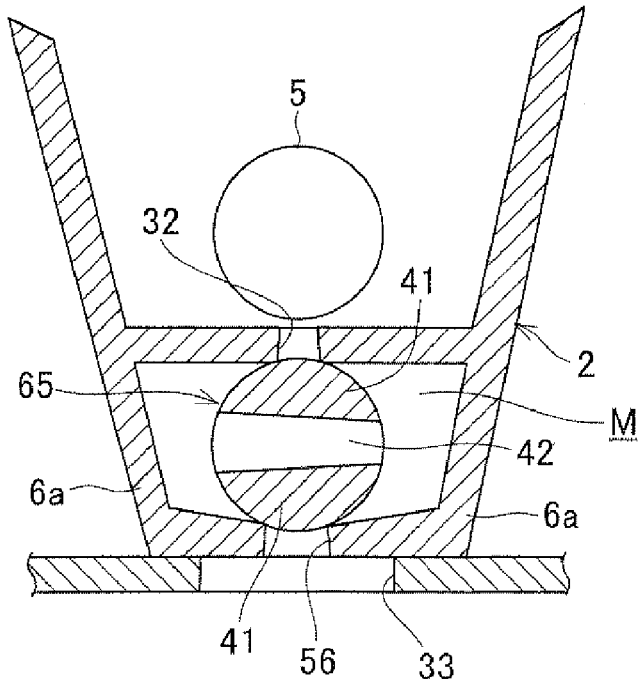

The open section 42 being the through-hole is more preferably in a shape which the cross-sectional shape in the direction perpendicular to the axial direction is a trapezoidal shape, broadening along the progressing direction of the toner, as like the rotating shutter 65 illustrated in FIGS. 14(*a*) and 14(*b*). In the state in which the supply opening 32 is open, the short side of the trapezoidal shape faces the supply opening 32, and the long side of the trapezoidal shape faces either the receiving opening 33 or the discharge opening 56. The discharge opening 56 is formed broader than the supply opening 32, in accordance with the shape of the open section 42.

The open section 42 of the rotating shutter 56 widens towards the progressing direction of the toner, therefore the toner flows smoothly, and is less likely for the toner to accumulate within the open section 42. FIGS. 14(*a*) and 14(*b*) are partial sectional views of the development device 57 illustrating the state in which the rotating shutter 65 is opening and shutting the supply opening 32.

Finally, a further modification being effective for the rotating shutters 4, 64 and 65 being explained in the First and Second Embodiments is explained below. The modification is explained based on an example where the modification is applied to the rotating shutter 65.

Figure 15A:
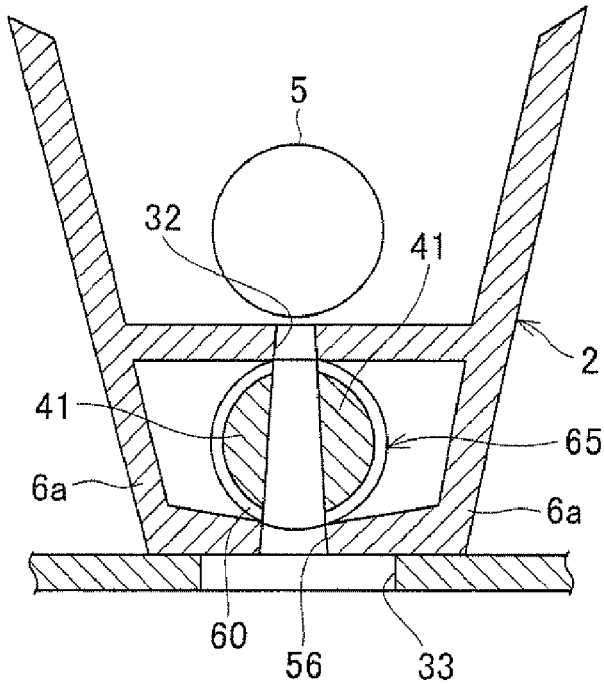
FIGS. 15(*a*) and 15(*b*) are partial sectional views of a development device of another modification of the Second Embodiment.
Figure 15B:
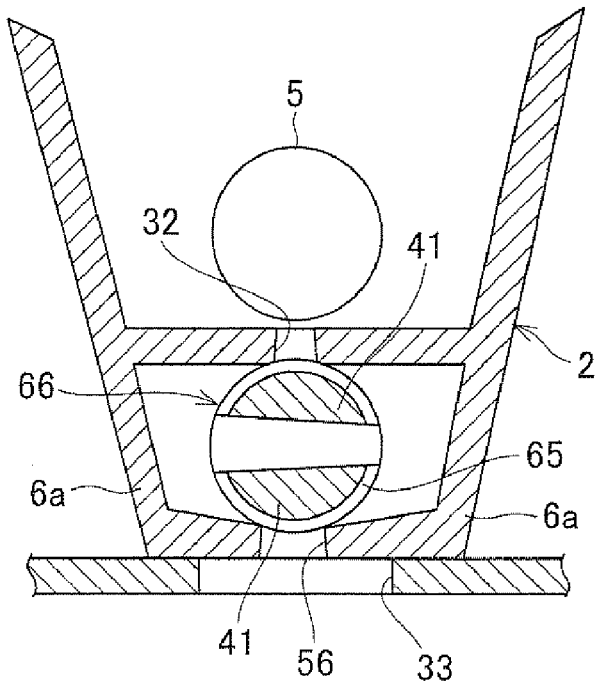

As illustrated in FIGS. 15(*a*) and 15(*b*), the outer surface of the roller-shaped main section in the shutting sections 41 shutting the supply opening 32 and the discharge opening 32 has a sealing member 60 provided on the whole surface.

As the sealing member 60, a sealing material having a cushioning property and low frictional properties, with a polyethylene terephthalate (PET) film layer on the surface of an elastic member such as a polyurethane foam or the like may be used. An easy method of mounting the sealing material to the outer surface of the roller-shaped main section is to use an adhesive agent, however this technology is not limited to this.

By providing the sealing member 60 on the outer surface of the rotating shutter 65, the sealing member 60 with the elasticity can eliminate the space created between the shutting sections 41, the supply opening 32 and the discharge opening 56, and can improve the sealing property. As a result, the scrape through of the toner can be effectively inhibited, thereby further preventing the dirtying of the apparatus caused by the toner.

As above, the development device and the image forming apparatus includes a developing tank, which is detachable, for containing a two component developer including toner and carrier; a toner supply device for containing toner and supplying the toner to the developing tank; a communicating chamber between a supply opening and a receiving opening, for communicating an inside of the toner supply device and an inside of the developing tank, wherein the supply opening is formed on the toner supply device and the receiving opening is formed on the developing tank and receives the toner from the supply opening; and a shutter member being supported rotatably in the communicating chamber, for opening and shutting the supply opening in conjunction with attachment and detachment operation of the developing tank, the shutter member including a roller-shaped main section with an open section formed extending in an axial direction thereof as well as opened in a direction perpendicular to the axial direction, for shutting the supply opening by covering the supply opening with an outer surface of the roller-shaped main section, and opening the supply opening by communicating the supply opening and the receiving opening through the open section.

Thus, the development device and the image forming apparatus equipped with such development device is provided in which the supply opening of the toner supply device can be unfailingly shut for a long term.

In addition, the development device and the image forming apparatus may further include a blocking wall in the vicinity of the receiving opening side of the communicating chamber, for blocking the communicating chamber from the receiving opening; the communicating chamber communicating with the developing tank through a discharge opening formed on the blocking wall and the receiving opening; and the shutter member shutting the discharge opening by covering the discharge opening with the outer surface of a roller-shaped main section, when the shutter member shuts the supply opening by covering the supply opening with the outer surface of the roller-shaped main section.

Thus, the development device and the image forming apparatus equipped with such development device is provided, in which the development device not only can unfailingly shut the supply opening of the toner supply device for a long term, but also can prevent dirtying caused by the toner adhered on the periphery of the shutter member.

In addition, the development device and the image forming apparatus may include an interlocking member for operating the opening and shutting operation of the shutter member in conjunction with the attachment and detachment operation of the developing tank, the interlocking member including a straight member of an unhollowed cylindrical shape, for reciprocating straightly along with the attachment and detachment operation of the developing tank, the straight member being contactable with part of the developing tank; and a rotating member of a hollow cylindrical shape connected to one end of the shutter member on the axial direction, for rotating in accordance with the straight-line movement of the straight member being inserted into and drawn out from the rotating member, the straight member, the rotating member and the shutter member being arranged concentrically.

The above structure rotates the shutter member by converting the straight-line movement to the rotation movement when attaching and detaching the developing tank, by the interlocking section including the straight member and the rotating member. The straight member, the rotating member and the shutter member are arranged concentrically, thereby the space required to arrange the shutter member can be kept small, which results to the downsizing of the development device, consequently the downsizing of the image forming apparatus equipped with such development device.

In addition, the development device and the image forming apparatus may be arranged such that the straight member has a projection on an outer surface thereof, and the rotating member has a spiral engaging section engaging to the projection, the projection being movable in the engaging section relatively in conjunction with reciprocation of the straight member, and rotation of the straight member is restrained.

In the structure, the engaging section on the rotating member is of a spiral shape. Therefore, the rotating member reversibly rotates depending on the moving direction of the straight member, either the direction being inserted into or the direction being drawn out. Therefore, for example, in a structure in which the rotating member rotates only if the straight member moves in the inserting direction, a structure to have the rotating member rotate for the movement of the straight member in the direction being drawn out will be necessary separately, however the structure has no such necessity. As a result, the space required to arrange the shutter member being a roller-shape can be made smaller even more. Thereby, downsizing of the development device, consequently the image forming apparatus equipped with such development device is possible.

In addition, the development device and the image forming apparatus may be arranged such that the open section of the shutter member is a through-hole hollowed from one side to the opposite side via a rotating axis.

For example, the open section can be formed by cutting off the roller-shaped main section, leaving a part of the outer surface of the roller-shaped main section in the axial direction, however this would cause the adhering of toner on the inner walls of the communicating chamber. On the other hand, by forming the open section with the aforementioned through-hole, the toner is supplied to the developing tank through this through-hole. Thus, it is less likely for the toner to adhere on the inner walls of the communicating chamber, and the dirtying caused by the adhered toner within the communicating chamber can be reduced, even without providing the discharge opening in the communicating chamber. Furthermore, if the open section is formed in the shape which the shutter member is cut off with a part of the outer surface of the roller-shaped main section left in the axial direction, securing the rigidity of the shutter member is difficult depending on the material. However, with this structure, even if it is the same material, the rigidity can be enhanced.

In this case, a cross-sectional shape of the through-hole in the direction perpendicular to an axial direction is preferably a rectangular shape. By having the through-hole in such shape, the toner will less likely accumulate within the through-hole. Moreover, the through-hole may be formed with low-cost, therefore may conspire cost reduction of the development device, consequently the image forming apparatus equipped with such development device.

Furthermore, in this case, the through-hole may be arranged such that a cross-sectional shape of the through-hole in the direction perpendicular to the axial direction is a trapezoidal shape, and in a state the supply opening is open, the short side of the trapezoidal shape faces the supply opening, and the long side of the trapezoidal shape faces either the receiving opening or the discharge opening.

The through-hole of the shutter member widens towards the progressing direction of the toner, therefore the toner is further less likely to accumulate within the through-hole.

In addition, the development device and the image forming apparatus is further preferable such that the shutter member is formed using a resin material including an electrically conductive material. By using the resin material including the electrically conductive material as the material for the shutter member, triboelectric charging is unlikely to occur, and can prevent the adhering of the charged toner to the shutter member by electrostatic force, caused by the supplied toner being charged by the friction with the shutter material.

In addition, the development device and the image forming apparatus is further preferably arranged such a ten-point height of irregularity Rz of the surface of the shutter member is equal to or under 2 micron. Thus, the adhering of the toner on the surface of the shutter member can be prevented even if the toner receives stress.

In addition, the development device and the image forming apparatus may include a sealing member on the outer surface of the shutter member, the sealing member being elastic.

According to the structure, the elastic sealing member can eliminate the space between the outer surface of the shutter member and the supply opening or the discharge opening, whereby improving the sealing property. Therefore, the scrape through of the toner from the spaces can be effectively inhibited, further preventing the dirtying of the apparatus caused by the toner.

The embodiments and concrete examples of implementation discussed in the foregoing detailed explanation serve solely to illustrate the technical details of the technology, which should not be narrowly interpreted within the limits of such embodiments and concrete examples, but rather may be applied in many variations within the spirit of the technology, provided such variations do not exceed the scope of the patent claims set forth below.

What is claimed is:

1. A development device comprising:

a developing tank, which is detachable, for containing a two component developer including toner and carrier;

a toner supply device for containing toner and supplying the toner to the developing tank;

a communicating chamber between a supply opening and a receiving opening, for communicating an inside of the toner supply device and an inside of the developing tank, wherein the supply opening is formed on the toner supply device and the receiving opening is formed on the developing tank and receives the toner from the supply opening; and a shutter member being supported rotatably in the communicating chamber, for opening and shutting the supply opening in conjunction with an attachment and detachment operation of the developing tank, wherein a rotational axis of the shutter member is arranged parallel to an insertion and removal direction of the developing tank, the shutter member comprising a roller-shaped main section with an open section formed extending in an axial direction thereof as well as opened in a direction perpendicular to the axial direction, for shutting the supply opening by covering the supply opening with an outer surface of the roller-shaped main section, and opening the supply opening by communicating the supply opening and the receiving opening through the open section.

2. The development device as set forth in claim 1, comprising:

a blocking wall in the vicinity of the receiving opening side of the communicating chamber, for blocking the communicating chamber from the receiving opening;

the communicating chamber communicating with the developing tank through a discharge opening formed on the blocking wall and the receiving opening; and the shutter member shutting the discharge opening by covering the discharge opening with the outer surface of the roller-shaped main section, when the shutter member shuts the supply opening by covering the supply opening with the outer surface of the roller-shaped main section.

3. The development device as set forth in claim 1, further comprising an interlocking mechanism for operating the opening and shutting operation of the shutter member in conjunction with the attachment and detachment operation of the developing tank, the interlocking mechanism comprising:

a straight member that moves in a linear direction during an attachment and detachment operation of the developing tank, the straight member being contactable with part of the developing tank; and a rotating member of a hollow cylindrical shape connected to one end of the shutter member, wherein an end of the straight member is mounted inside a hollow center of an end of the rotating member, and wherein the rotating member rotates in response to linear movements of the straight member into and out of the rotating member.

4. The development device as set forth in claim 3, wherein the straight member has a projection on an outer surface thereof, and the rotating member has a spiral engaging section engaging to the projection, the projection being movable in the engaging section relatively in conjunction with linear movements of the straight member, and wherein rotation of the straight member is restrained.

5. The development device as set forth in claim 1, wherein the open section of the shutter member is a through-hole hollowed from one side to the opposite side via a rotating axis.

6. The development device as set forth in claim 5, wherein a cross-sectional shape of the through-hole in the direction perpendicular to an axial direction is a rectangular shape.

7. The development device as set forth in claim 5, wherein a cross-sectional shape of the through-hole in the direction perpendicular to the axial direction is a trapezoidal shape, and in a state the supply opening is open, the short side of the trapezoidal shape faces the supply opening, and the long side of the trapezoidal shape faces the receiving opening.

8. The development device as set forth in claim 1, wherein the shutter member is formed using a resin material including an electrically conductive material.

9. The development device as set forth in claim 1, wherein ten-point height of irregularity Rz of the surface of the shutter member is equal to or under 2 micron.

10. The development device as set forth in claim 1, comprising a sealing member on the outer surface of the shutter member, the sealing member being elastic.

11. An image forming apparatus comprising:

a development device for developing an electrostatic latent image, the development device comprising:

a developing tank, which is detachable, for containing a two component developer including toner and carrier;

a toner supply device for containing toner and supplying the toner to the developing tank;

a communicating chamber between a supply opening and a receiving opening, for communicating an inside of the toner supply device and an inside of the developing tank, wherein the supply opening is formed on the toner supply device and the receiving opening is formed on the developing tank and receives the toner from the supply opening; and a shutter member being supported rotatably in the communicating chamber, for opening and shutting the supply opening in conjunction with an attachment and detachment operation of the developing tank, wherein a rotational axis of the shutter member is arranged parallel to an insertion and removal direction of the developing tank, the shutter member comprising a roller-shaped main section with an open section formed extending in an axial direction thereof as well as opened in a direction perpendicular to the axial direction, for shutting the supply opening by covering the supply opening with an outer surface of the roller-shaped main section, and opening the supply opening by communicating the supply opening and the receiving opening through the open section.

12. The development device as set forth in claim 1, wherein the supply opening, the receiving opening and the shutter member all extend parallel to the insertion and removal direction of the developing tank for more than half a total length of the developing tank.

13. The development device as set forth in claim 1, further comprising an interlocking mechanism that causes the shutter member to rotate between opened and closed positions when the developing tank is moved in the insertion and removal directions, wherein a straight member of the interlocking mechanism is moved in a linear direction that is parallel to the rotational axis of the shutter member when the developing tank is moved in the insertion and removal directions, and wherein the interlocking mechanism converts linear movements of the straight member into rotational movements of the shutter member.

14. The development device as set forth in claim 13, wherein the interlocking mechanism further comprises a rotating member having a first end that is coupled to the shutter member, and wherein a second end of the rotating member is operatively coupled to the straight member such that linear movements of the straight member cause the rotating member to rotate.

15. The development device as set forth in claim 14, wherein a projection is formed on one of the straight member and the rotating member, and wherein a groove is formed on the other of the straight member and the rotating member, and wherein the projection is received in the groove such that linear movement of the straight member causes relative movement between the projection and the groove, the relative movement causing the rotating member to rotate.

16. The development device as set forth in claim 15, wherein the groove is spiral shaped, such that movement of the projection along the groove causes the rotating member to rotate.

17. The development device as set forth in claim 14, wherein a cam surface is located on one of the straight member and the rotating member, and wherein a reaction surface is located on the other of the straight member and the rotating member, and wherein linear movement of the straight member cause the cam surface to interact with the reaction surface such that the rotating member rotates.

18. The development device as set forth in claim 17, further comprising a biasing member that biases the rotational member to rotate in a first rotational direction.

19. The development device as set forth in claim 18, wherein insertion of the developing tank causes the straight member to move in a first linear direction from an extended position to a retracted position, and wherein linear movement of the straight member in the first linear direction causes the rotational member to rotate in a second rotational direction opposite to the first rotational direction against the biasing force of the biasing member.

20. The development device as set forth in claim 13, further comprising a biasing member that biases the straight member to move in a first linear direction towards an extended position, wherein insertion of the developing tank causes the straight member to move in a second linear direction from the extended position to a retracted position against the biasing force of the biasing member.

* * * * *